United States Patent [19]

Fraile et al.

[11] Patent Number: 5,002,787

[45] Date of Patent: Mar. 26, 1991

[54] METHOD FOR DRYING PRODUCTS IN DIVIDED FORM, PARTICULARLY CEREALS

[75] Inventors: Patricia Fraile, Champagne; Henri Renon, Sceaux, both of France

[73] Assignee: Association pour la Recherche et le Des Methodes et Processus Industrieles (A.R.M.I.N.E.S.), Paris, France

[21] Appl. No.: 448,686

[22] Filed: Dec. 11, 1989

Related U.S. Application Data

[63] Continuation of Ser. No. 140,653, Jan. 4, 1988, abandoned, which is a continuation-in-part of Ser. No. 139,190, Dec. 29, 1987, abandoned.

[30] Foreign Application Priority Data

Jan. 5, 1987 [FR] France ..... 87-00031

[51] Int. Cl.[5] ..... A23B 9/08; F26B 17/26

[52] U.S. Cl. ..... 426/233; 426/465; 426/467

[58] Field of Search ..... 426/465, 467, 469, 231, 426/233; 34/10, 57 A, 57 R; 99/516, 470

[56] References Cited

U.S. PATENT DOCUMENTS

| | | | |
|---|---|---|---|
| 3,821,450 | 6/1974 | Stauber | 426/469 |
| 4,126,945 | 11/1978 | Manser et al. | 34/10 |
| 4,395,830 | 8/1983 | Lockwood | 34/10 |
| 4,478,141 | 10/1984 | Svenssen et al. | 99/474 |

FOREIGN PATENT DOCUMENTS

| | | |
|---|---|---|
| 160431 | of 0000 | Canada . |
| 8300674 | of 0000 | France . |

*Primary Examiner*—Steve Alvo

*Attorney, Agent, or Firm*—Bierman and Muserlian

[57] ABSTRACT

A process is provided for drying products in divided form, particularly cereals, and an apparatus for implementing this process. This process is based on the principle of placing the material to be dried (cereal grains, food grains, food seeds, etc.) in suspension in a gaseous stream forming the hot drying fluid. In accordance with the invention, alternate steps are provided for drying and sweating the material during treatment, the sweating involving absence of drying fluid flow about the grains. An apparatus for implementing this process includes a casing with vertical axis in which is mounted at least one perforated horizontal plate supporting the fluidized bed, a blade being movable perpendicularly to the plate, two side hoppers with mobile bottoms being associated with each plate, a blade being mounted in each hopper.

18 Claims, 5 Drawing Sheets

METHOD FOR DRYING PRODUCTS IN DIVIDED FORM, PARTICULARLY CEREALS

PRIOR APPLICATION

This application is a continuation of U.S. patent application Ser. No. 140,653 filed Jan. 4, 1988 which is a continuation-in-part of U.S. patent application Ser. No. 139,190 filed Dec. 29, 1987, both now abandoned.

BACKGROUND OF THE INVENTION

1. Field of the Invention

The invention relates to a method for drying products which are in a divided form, for example grains, particles or small plates. It also applies advantageously to the drying of products the drying kinetics of which is limited by the internal diffusion of water and which desirably have to be dried in depth, with a drying uniformity from grain to grain, providing that the grains, during drying, do not lose their qualities by thermal decomposition. By way of examples of such products, cereals may be mentioned such as corn and maize and other food seeds such as sunflower seeds. The invention also relates to apparatuses for implementing this method.

This method is based on the principle of placing the product to be dried in suspension in a gaseous stream constituting the hot drying fluid. A thick layer of the product to be dried is formed and a rising stream of said hot fluid is caused to pass therethrough, where it then takes the appearance of a boiling fluid, being continuously stirred, and it occupies the whole of the space which is reserved for it up to its free surface, in the manner of a liquid, the speed of the gaseous stream being adapted to the physical characteristics of the product. This technique, called "fluidized bed drying", allows to improve the drying phenomena at the level of the thick layer, thus promoting thermal exchanges.

As a matter of fact, dihedral duct driers are known for the drying of cereals. Such driers are very often divided into several superposed boxes, where the thermal treatment is different as the grain moves down by gravity around the ducts which distribute the hot air inside the grain mass. However, the air/product contact is not optimum and preferential air passages are formed causing a heterogeneous treatment of the product. Furthermore, in order to be effective, such apparatuses must be of a very large size and require considerable investments; the smaller driers of this type, called "farm driers" have very poor yields (about 1500 kcal/kg of evaporated water), the residence time of the grain in the apparatus varying between 5 and 11 hours.

In the agro-alimentary field which, as this was mentioned above, forms one of the fields of application of the present invention, because the agro-alimentary products often require drying before packing, different types of driers are known using the fluidized bed drying principle, these driers being able to be classed in two types:

the first type is that of driers in which the drying agent must provide for the transport and drying of the product, and in which is included the drier described in the Czech patent n° 183 578, which is a single stage driers, and the drier described in French Patent N° 83 00674 which is a multi-stage drier. In driers of this type, the uniformity of the thermal treatment, provided by putting the grains in suspension, is largely impaired by a bad distribution of the residence times owing to the random displacement of the particles. Furthermore, single stage driers are generally poorly adapted to the drying of particles, when the internal diffusion of the bound water is the limiting step of the process. As a matter of fact, the apparatus must be adapted so that the minimum residence time of the product corresponds to the mean residence time so as to obtain an adequate treatment of the grains. However, the total residence time of the product must be optimized so as to retain the food quality thereof. Because of the large dispersion of the residence times, the size of the apparatuses is relatively large and this results in the use of very high air rates, the imperative recycling of which is difficult to carry out.

the second type is that of driers in which the drying agent provides for drying of the product, whereas the transport thereof is provided by mechanical means. Belonging to this type are the drier disclosed in Canadian Patent n° 160431, which is a single stage drier, and that disclosed in the Bulgarian publication A.I. DRAGANOV: "Trudove Na Nauchnoiezsledovatelskija Institut Po E'rnosakhranenie E'rnoprerabotka I Khlebproproizvodstvo (SOFIA), 1971; V.2; 61-73", which is a four stage drier. In the driers of this second type, the distribution of the residence times is perfectly controlled by mechanical means, which consist of vertical baffles causing displacement of the grain layers over perforated plates which act as gas distributors. The apparatuses of this type having only one stage have the same drawbacks as those mentioned above. Insofar as the Bulgarian apparatus is concerned, its design does not allow the air to pass from one stage to another. Each stage is fed alternately with a hot air (125° C.) or a cold air (15° C.) supplied by an independent fan. Now, under fluidization, the air flow required is proportional to the area of the bed to be fluidized. It can be seen in this case that the flow of the air to be heated is twice as large as the flow which would be useful if the air passed from one stage to another. Furthermore, during cooling in the two stages provided for this purpose, the heat yielded up by the maize is not recovered, it is partly for these two reasons that the energy consumption is fairly high (of the order of 1400 kg/cal per kilo of water evaporated).

The limiting step in drying the maize is the diffusion of water from inside the grain towards the surface, this diffusion is improved by heating the grain and it is advantageous to maintain it at a given temperature, for a given time, without any circulation of drying air, so as to accelerate the diffusion without an additional supply of energy.

In the Bulgarian drier, the fact of cooling the grain between two drying steps is an energy consuming action, since:

the heat supplied for heating the grain is lost, the internal diffusion of the water is slowed down, energy is used for fluidizing.

Existing driers have never succeeded in providing simultaneously the uniformity of the residence times of the grain and efficient fluid flow from the energy point of view. The present invention allows to conciliate these objects by providing a compartmentalized flow of the grain and passage of the drying air from one drying stage to another in a countercurrent wise with respect to the material to be dried.

The uniformity of the residence times of the grain in the different sections of the apparatus is important for conciliating the thorough drying of the grain and the maintainance of its food qualities. The migration of humidity in the grain requires a certain time for diffusion, this diffusion being faster if the temperature of the grain increases. On the other hand, the loss of the food qualities (or others) depends essentially on the time during which it is maintained at a high temperature. In order to provide at best required compromise between drying speed and maintenance of quality, the temperature and drying time should be chose optimally. This is only possible if all the grains have the same thermal history. To the extent that the residence times are not the same for all the grains in a given stage, assumed as being at an homogeneous temperature, it is not possible to provide the best compromise for all the grains. Some grains held at a high temperature for a short period of time will not be dry, whereas others kept at a high temperature for too long a time will have lost their qualities (they will be cooked).

Attempts have therefore been made to provide a favourable circulation of the grains and of the drying fluid, making possible an homogenous distribution of the residence times, which leads to partitioning the fluid bed of grains which, without that, would be totally mixed and would lead to a wide spread of the residence times in the "population" of the grains. The partitioning itself must be movable, so as to make possible the displacement of the grains in a continuous process, that is to say where the temperature remains constant as a function of time at a given point.

SUMMARY OF THE INVENTION

The subject matter of the present invention is therefore first of all a method for drying a material which is in a divided form, capable of being dried uniformly by contacting said material in a fluidized bed with a hot upward flowing drying fluid, which method includes alternating steps for drying and sweating the material under treatment, the sweating involving the absence of circulation of the drying fluid about the grains. Advantageously, the drying and sweating times are adjusted throughout the process as a function of the degree of humidity of the material to be dried.

Furthermore, the transport of the material to be dried is provided by means other than the drying fluid, particularly by mechanical means allowing division into partitioned sectors so as to avoid the axial mixing of the particles.

Furthermore, the method of the invention includes at least one treatment stage and, preferably, a plurality of such superposed stages. In this case, the same drying fluid flow is used, that it is advantageous to recycle in the process, which results in an appreciable decrease of the fluid flow required: by way of comparison, for two apparatuses of identical size, the air flows used in a drier of a known type (farm drier with dihedral ducts) and in a drier of the invention are the following: 7.8 $m^3$/second for the known drier and 4.5 $m^3$/second for the drier of the present invention. This constitutes an improvement with respect to the drier described in the above mentioned Bulgarian publication. In the case of using a multi-stage drier, the surface area of the stages can be advantageously varier by adjusting the drying time/-sweating time ratio.

In accordance with another advantageous characteristic of the method of the invention, the transfer of the material to be dried from one stage to another one takes place outside the fluidization zone, so as to facilitate this transfer (in the absence of countercurrent air circulation), to save on drying fluid and to avoid useless pressure drops.

In addition, the temperature of the drying fluid may be advantageously modified between different treatment blocks, each having at least one treatment stage. Preferably, an upper block comprising a predrying stage, at least one intermediate block comprising a plurality of drying stages and a lower block comprising at least one stage for cooling the material at the end of drying are provided.

Furthermore, in accordance with an advantageous characteristic of the process of the invention, the material to be dried is freed of cobs and other light waste driven to the free surface of the fluidized bed in the upper predrying stage. The waste which floats on the surface of the fluidized bed may be removed by a mechanical means, scraping of the surface and passing over an overflow or sucked to the surface by moderate suction of the drying fluid. The finer waste, such as follicles, are carried along with the drying fluid stream from where they may be collected by cyclone effect or by slowing down the speed of the fluid stream (widening of the passage section) before possible recycling thereof.

According to another feature of the process of the invention, for a given unit and for identical heating characteristics of the drying fluid, the speed of transporting the material to be dried in each stage is adjusted depending on the degree of humidity of material to be treated. This possibility is of a great practical interest. For a given unit and for identical characteristics of the speed of transporting the material to be dried the heating characteristics may also be varied.

The rate of humidity of the material to be dried may also be checked at different points so as to modify as required the drying-sweating conditions by the transport speed of the material to be dried and/or the temperature of the drying fluid.

The purpose of sweating is to allow the humidity inside the grain to diffuse for a sufficient time, without consuming drying fluid. The purpose of the crying fluid is multiple: to transfer heat to the grain so as to heat it and cause vaporization of the water, to transfer the water vapor far from the surface of the grain. It happens in certain drying phases that these operations are faster than the migration of humidity in the grain, which justifies sweating, during which period the humidity migrates from inside the grain towards the surface without consumption of drying fluid.

The combination of the above mentioned characteristics of the process of the invention makes it possible to reduce to a large extent the drying cycle times, the size of the driers, and the energy costs, the alternance of drying-sweating steps providing the best drying conditions. The invention therefore offers the possibility of constructing farm driers with optimized operation (cycle of 1 hour instead of the 7 to 11 hours for known farm driers, for driers of the same size).

Concurrently, in the case where the material to be dried is formed of cereals or food grains, by a proper choice of the treatment temperatures, the food quality of the grains is safeguarded. This quality is evaluated as a of the amounts of amino-acids (such as lysine, cystine and methionine in so far as maize is concerned) still present in the grains after drying. Thus, it has been shown that when the rate of humidity of the maize grains is greater than 20%, the temperature of the grain may reach about 120° C. in the upper stage of the process without excessive damage to the proteins. Then, the drying must be continued, in the intermediate stages, at a temperature of about 90° C. before cooling and ensilage.

The present invention also provides two apparatuses for implementing the process which has just been described, the first having the advantage of withstanding pressure well, and the second having the advantage of being of modular construction.

The first of these apparatus comprises:

an external cylindrical casing with vertical axis in which is mounted at least one stationary horizontal circular plate forming the lower limit of a fluidized bed stage, a shaft capable of pivoting on itself being mounted along this axis, said shaft having as many series of radial blades as there are plates, said blades, which define compartments for the material to be dried displacing the material present on said plate, each plate having a perforated part corresponding to the drying fluid passage zone, a closed part corresponding to a sweating zone and an open part, the material to be dried arriving on a plate on a section of its closed part and then passing onto a perforated part, then onto a closed section for sweating, or alternately over several perforated and closed parts and being at the end of travel, discharged by its open part;

a means for causing the rotational movement of the shaft; and a means for transporting the treatment fluid in the upward direction.

Each plate may include a main perforated part in one piece, occupying a variable fraction of the surface of the plate, the open part being inserted in the remaining closed part.

In accordance with a variant, each plate comprises alternating perforated regions and closed regions, the open part being inserted in a closed region.

Furthermore, according to a particularly preferred embodiment, each plate may be considered as being divided into identical sectors, the open parts corresponding to a sector, the number of blades associated with a plate being equal to the number of sectors.

The second apparatus of the present invention comprises:

a parallelepipedic casing with vertical axis in which is mounted at least one perforated horizontal plate forming the lower limit of a fluidized bed stage, a blade being capable of moving perpendicularly to said plate from one end to the other thereof while closing or opening, depending on whether it is in one or other of its end positions, an aperture formed in the wall of the casing above said plate, two external lateral hoppers being associated with each plate, each hopper being defined by an external wall common to the whole of the apparatus and by a bottom located in the same plane as said plate and capable of occupying a position adjacent thereto for filling the hopper and sweating of its contents or an externally offset position for discharging the contents of the hopper to the lower stage, a blade perpendicular to the bottom of each hopper being mounted for translational movement between said external wall and the wall of the casing comprising said aperture and being capable of closing this aperture in its corresponding end position;

a means for moving the blades and the bottoms of the hoppers in translation; and a means for transporting the treatment fluid in the upward direction in a single flow.

In accordance with characteristics common to both apparatuses: the stages are disposed in blocks of at least one stage, these blocks being separated by plates allowing the material to be dried to pass through, the drying fluid being able to communicate from one block to another, either directly in an internal way, or through an external duct in which is located a heat source or heat exchanger member for modifying the temperature of the drying fluid; they may incluse a dust removal means of the cyclone type disposed at the outlet of the drying fluid: the casing comprises at least one inspection trap.

BRIEF DESCRIPTION OF THE DRAWINGS

To better understand the subject matter of the present invention embodiments of the devices and apparatuses for drying maize in accordance with the invention will be described in greater detail, by way of indication and in a way which is in no wise limitative, with reference to the accompanying drawings. In these drawings.

DESCRIPTION OF THE PREFERRED EMBODIMENTS

Figure 1:
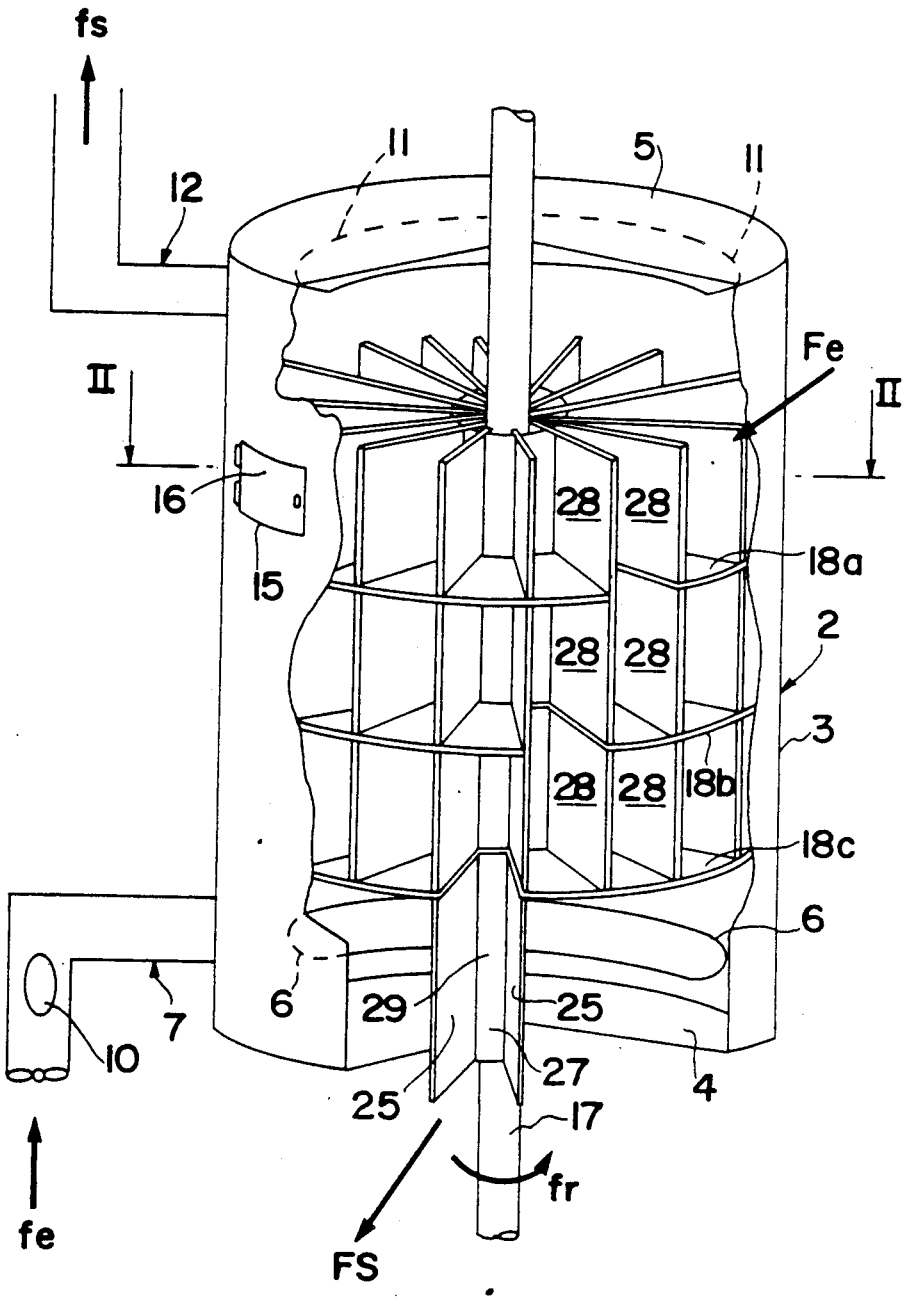
FIG. 1 is a schematical perspective view of a drying device according to a first embodiment of the present invention, parts being cut away to show the internal structure of said apparatus.
Figure 2:
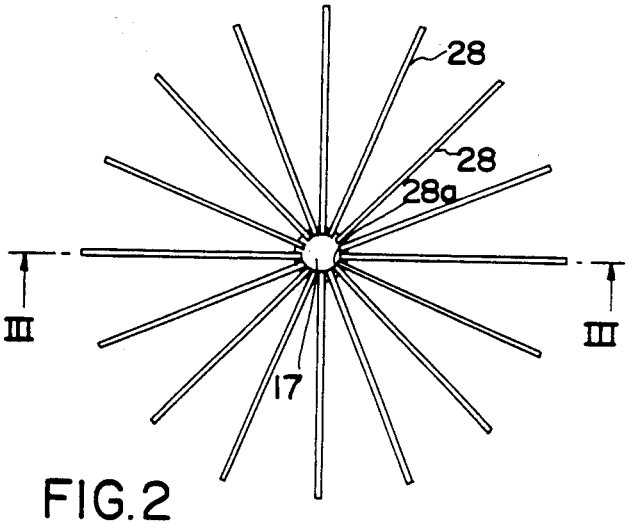
FIG. 2 is a partial sectional view through II—II of FIG. 1.
Figure 7:
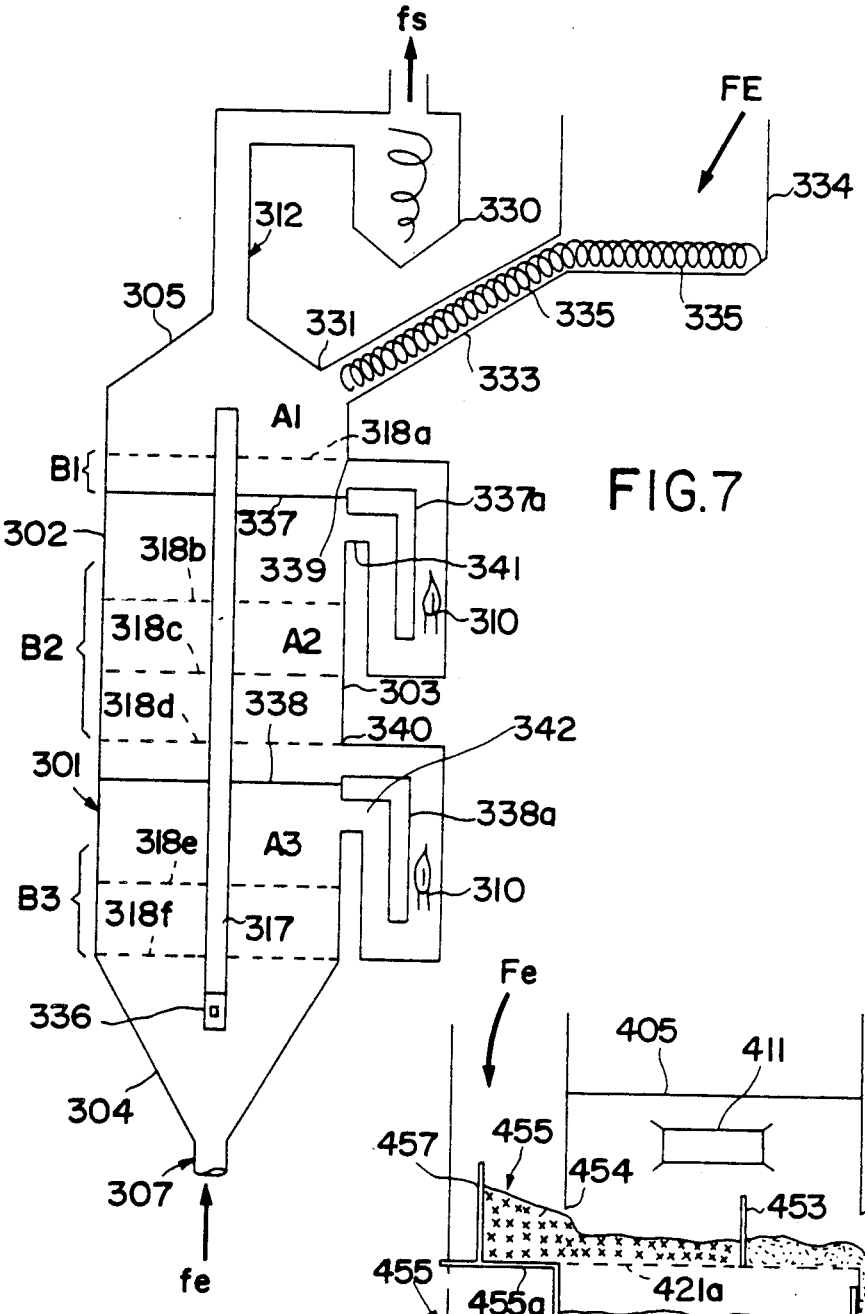
FIG. 7 is a schematical axial sectional view of a complete apparatus for drying maize, including several drying blocks, the intermediate block corresponding, in its general construction, to the device shown in FIG. 1.

Referring to FIG. 1, a device has been shown at 1,; as a whole, which forms one of the drying blocks of the complete drier of FIG. 7.

This device 1 is formed by a cylindrical external casing 2 having cylindrical side wall 3 connected on the one hand to a flat bottom 4 and on the other hand to a flat upper wall 5.

In the side wall 3, in the vicinity of bottom 4 and in a plane parallel thereto, is formed an aperture 6 through which an external pipe 7 opens inside said casing 2, for feeding air inside casing 2. This pipe 7 shown, in one possible embodiment, as being connected perpendicularly to the axis of casing 2, is directly connected thereto sealingly. Inside this pipe 7 is disposed a heat source or heat exchanger shown symbolically and designated by the reference 10. The arrow fe symbolizes the direction of displacement of the air fed either under compression by means of at least one fan or by extraction, by means of at least one fan, or by a combination of these two modes, these fans not been shown in the drawings.

Similarly, in the side wall 3 of casing 2, in the vicinity of the upper wall 5, an opening 11 is formed disposed in the same plane parallel to said upper wall 5 and located in line with aperture 6. This opening 11 places the inner space of casing 2 in communication with a pipe 12 for the extraction of air. This pipe 12 shown, in accordance with a possible embodiment, as being connected perpendicularly to the axis of casing 2, is connected thereto sealingly. Arrow fs symbolizes this air extraction.

Furthermore, casing 2 includes, between the zones formed with openings 6 and 11, other openings 15 forming inspection traps, disposed at different positions, one opening 15 of this type being shown in FIG. 1. These openings 15 can be closed sealingly by flaps 16 which may be opened externally for cleaning and checking the internal assemblies of the apparatus. Furthermore, these traps 15 are adapted for use by the safety services in the case of fire.

Casing 2 has passing therethrough an axial shaft 17, capable of being rotated by a motor (not shown in FIG. 1), the bottom wall 4 and the upper wall 5 of casing 2 each having a central opening for this purpose.

Inside casing 2 are fixedly disposed parallel to said walls 4 and 5 three plates 18 (referenced respectively 18*a*, 18*b* or 18*c*) which may be located at equal distances from each other, the lower plate 18*c* being located on opening 6.

Each plate 18 (FIG. 4) whose general shape is that of a disk, has a central opening 19 dimensioned for passing shaft 17 and rests, by its free edge 20, which substantially engages with the side wall 3 of said casing 2, on retention means (not shown) carried internally by said wall 3.

Figure 4:
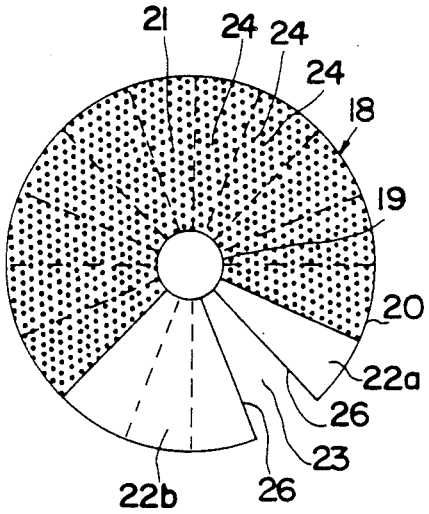
FIG. 4 is a schematical top view of a plate equipping the device of FIG. 1.

In addition, as can be seen in FIG. 4, each plate 18 has three parts each corresponding to a certain number of sectors of the disk, this latter being virtually divided into sixteen sectors in the example shown. These three parts may be described as follows:

- a part 21 formed with a plurality of perforations 24 and corresponding to eleven sectors of the disk disposed side by side;
- a solid part 22 corresponding to four sectors, one (22*a*) of which is adjacent the edge sector of the perforated part 21 and the other three (22*b*) of which, disposed side by side, are adjacent the other edge sector of part 21;
- the remaining part 23 of the disk, which corresponds to a sector thereof which is not materialized and thus offers an opening in the plate.

Figure 6:
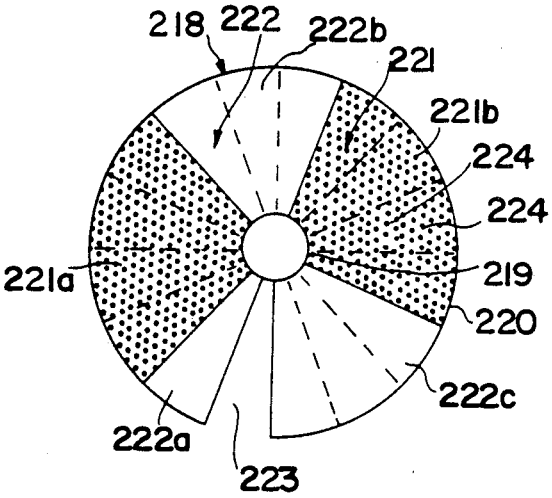
FIGS. 5 and 6 are views similar to FIG. 4 each showing a plate formed in accordance with a variant.
Figure 5:
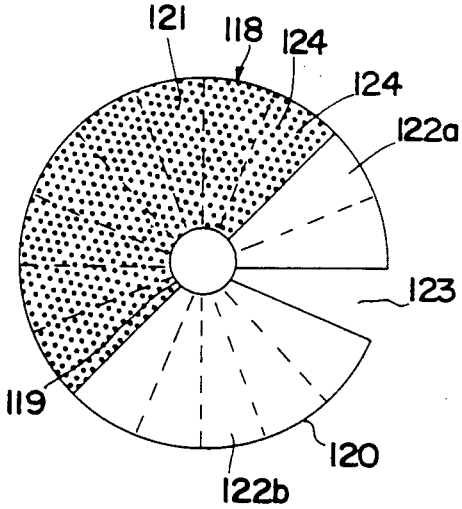

In FIGS. 5 and 6, variants of construction of the plate 18 of FIG. 4 have been shown, the corresponding elements of the plates respectively 118 and 218 of these variants being referenced by reference numbers greater than those of FIG. 4 respectively by 100 and 200.

Plate 118 differs from plate 18 by the fact that the part 121 only corresponds to eight sectors, that part 122*a* corresponds on the other hand to two adjacent sectors instead of one, and part 122*b*, to five adjacent sectors instead of three.

As for plate 218 shown in FIG. 6, it differs from plate 18 by the fact that three sectors of part 21 no longer have perforations 224 and correspond therefore to a solid part section 222*b*, the part formed by the three solid part sectors adjacent the non materialized section 223 being referenced by the reference number 222*c*. The perforated part 221 is therefore divided into two identical sections 221*a* and 221*b*.

Coming back now to FIG. 1, it can be seen that device 1 is completed by three radial plates 25 mounted perpendicularly to the lower plate 18*c*. Two of these plates are each connected to the two radial edges 26 (FIG. 4) of plate 18*c*, defining the open part 23, whereas the third one (29), disposed parallel to shaft 17, closes the tip of the angle formed by the other two. These three plates 25, 29 and the side wall 3 of casing 3 are extended downwards, beyond the bottom wall 4 which is open in the area located between these three plates 25. These latter define with casing 2 a channel 27 for discharging the maize.

As has already been mentioned, the three plates 18*a*, 18*b* or 18*c* equipping the drying device 1 are identical. However, they are each disposed with an angular offset of a sector, so that the open part 23 is offset every time by a sector in the reverse direction of rotation of shaft 17, the direction of rotation of shaft 17 being shown schematically by the arrow fr in FIG. 1.

Figure 3:
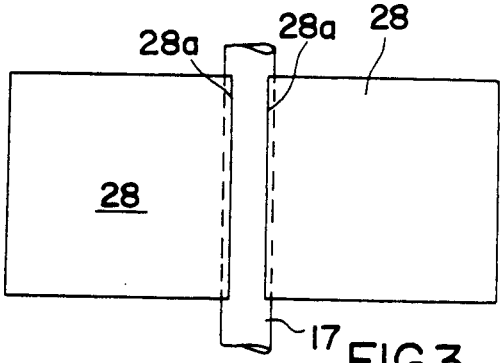
FIG. 3 is a partial sectional view through III—III of FIG. 2.

On said shaft 17 are fixed three identical series of rectangular blades 28, each of which is fixed above a plate 18 and includes sixteen radial blades, regularly spaced apart, each blade being fixed by its internal edge 28*a* (FIG. 3) to one of the vertical generatrices of the external cylinder of shaft 17.

In the assembled position, blades 18 extend widthwise practically up to the vicinity of the side wall 3 of casing 2 and, heightwise, over a distance practically equal to and slightly less than that separating two plates 18 in the fitted position.

In this position, each series of blades 28 forms, with the plate which is associated therewith (18*a*, 18*b* or 18*c*), a stage for treating maize grains. The upper free edge of blades 28 associated with the upper stage is located below opening 11.

In FIG. 1 there has also been shown by arrow Fe the input of maize grains into the drying device, their output being shown by arrow Fs. The grains penetrate either through an opening in wall 3 overlooking the upper plate 18*a* or through a channel 27 which joins the blocks together.

The operation of device 1 which has just been described is the following:

In the starting position, shaft 17 is rotated so that it is in the position shown in FIG. 1, that is to say that blades 28 are located in radial planes passing through radii dividing plates 18 into the different above mentioned sectors, the offset between the different plates being that mentioned above.

The maize to be dried is fed through the opening provided for this purpose, the maize then falling onto sector 22*a* of plate 18*a*. Simultaneously, the motor is started up so as to rotate shaft 17 in the direction of arrow Fr, as well as the compression or else extraction devices intended to create the circuit of the air inside casing 2 and, consequently, the superposed fluidized beds in the three stages of the apparatus 1.

The maize, thus fed onto plate 18*a*, begins by progressing over the upper stage, moved by the corresponding blades 28; it then passes over the perforated part 21 of this plate 18*a*, through which the rising air flows, after passing through the perforated parts 21 of the other two plates 18*b* and 18*c*. This air, heated to the desired temperature by the above mentioned means 10, provides drying of the maize in the fluidized bed. The progression of blades 28 will then bring the maize on the solid part 22*b* where, since it is no longer put in suspension in the air, undergoes sweating before arriving in part 23 where it falls by gravity onto part 22*a* of the plate 18 of the lower stage. There, the maize continues to undergo sweating, then it is again carried along in the fluidized bed drying cycle, before falling onto the lower plate 18*c*. On this plate, its progression is strictly identical, until it finishes by falling into channel 27, either towards another drying block, or towards the outlet of the apparatus if it has finished its drying cycle. The device which has been described could of course include a different number of stages, this number of stages depending on the total residence time of the grains in the apparatus 1 and on the residence time per stage. The diameter of casing 3 is variable as a function of the dry maize output to be obtained. The residence time of the bed of grains in each stage is adjusted by the rotational speed of the motor. The dry maize output also depends on the height of the layers of grains and on the rotational speed of the motor. The solid part 22 of each plate 18 corresponds to a number of sectors which depends on the number of stages and on the desired rest time. This is why plates 18 of the device of FIG. 1 could be replaced by plates 118 and 218 which were described above. In the case of plates 218, an additional sweating phase is provided between two fluidized bed drying phases.

Furthermore, for a given number of closed sectors, the sweating time varies with the rotational speed of the motor.

This rotation may take place continuously or intermittently and its speed is chosen as a function of the desired treatment and of the characteristics of the maize to be treated.

The power of the fan or fans is determined by the pressure loss caused by the layers of grains. This pressure drop varies as a function of the height of the beds of grains, of the difference in density between the treatment fluid (air) and the maize to be treated, and finally of the porosity of the bed, the porosity of the bed being the percentage of empty space in the total occupied volume.

Furthermore, on each plate, the maize stays for a given time since it flows all around the stage while remaining inside a partitioned sector, without axial mixing.

In FIG. 7 a more complete apparatus 301 has been shown for drying maize.

This apparatus includes an elongate casing 302 which has a cylindrical shaped wall 303 connected on the one hand to a bottom 304 and on the other hand to an upper wall 305. Bottom 304 is connected to an air intake duct 307 for creating the fluidized beds, as mentioned above. As for the upper wall 305 it is connected to the air discharge duct 312, on which is located a dust removal device 330, the branch of duct 312, downstream of said device 330, guiding the dust free air towards another treatment station which may be preheating of the maize in a hopper provided for this purpose.

Casing 302 has, in the junction zone between the side wall 303 and the upper wall 305, an opening 331 through which the casing 302 is connected to a duct 333 disposed obliquely with respect to the axis of device 301 and connected, at its other end, to a supply hopper 334. In the bottom of this hopper and in duct 333 sloping towards casing 302, is located an adjustable maize feed device, shown schematically at 335 in FIG. 7 and possibly consisting of an Archimedes screw, a transport belt or other similar device.

In the inner space defined by the side wall 303 is mounted for pivoting on itself an axial shaft 317 whose movement is controlled by a motor 336. This inner space is moreover divided into three regions A1, A2 and A3 by two plates 337 and 338 disposed perpendicularly to the side wall 303, the upper plate 337 being located substantially at a quarter of the height of said wall 303 and the lower plate 338 at a third of the height of this wall. These fixed plates 337 and 338 each have a central perforation for passing shaft 317 therethrough, as well as openings for the transfer of the maize from one block to the lower block.

In addition, drying fluid inputs and outputs are formed inside wall 303 the reference 339 designating the input in section A1, reference 340 the input into section A2, reference 341 the output from section A2 and reference 342 the output from section A3.

Heat sources or heat exchangers 310 are placed, on the one hand, between output 342 of section A3 and the input 340 of section A2 and, on the other hand, between the output 341 of section A2 and the input 339 of section A1.

It is possible to add fresh external fluid at the level of the heat sources or exchangers, so as to prevent the humidity saturation rate of the drying fluid from becoming too high.

Inside casing 302 are housed different plates 318*a* to 318*f*, which are similar to plate 18 of the device of FIG. 1. Plate 318*a* is disposed in region A1; plates 318*b*, 318*c* and 318*d* are disposed in region A2; as for the remaining plates 318*e* and 318*f* they are disposed in region A3.

With each plate is of course associated a set of blades disposed thereabove, such an assembly being identical to the one described with reference to FIG. 1. So as not to render the drawings unreadable, these blades have not been shown in FIG. 7.

If the sets of blades are assumed installed on shaft 317, it can be seen that an upper drying (predrying) block B1 with one stage has been formed, an intermediate drying block B2 with three stages and a lower block B3, which as will be seen hereafter is a block for cooling after drying. The device of FIG. 7 illustrates therefore a possible arrangement of the basic principle of the invention.

The operation of the device of FIG. 7 will now be described with reference to the example of maize.

Insofar as maize is concerned, the humidity rate on cropping may vary from 30 to 40% (namely from 0.428 to 0.666 kg of water/kg of dry material). By law, this rate of humidity must be reduced to 15% (namely to 0.176 kg of water/kg of dry material).

The cold and humid maize, possibly having undergone a preheating is fed to the upper part of the apparatus through hopper 334 and duct 333 into region A1 where it progresses as was described above until it is discharged into a channel similar to channel 27 described with reference to FIG. 1, and which passes through plate 337.

Then, the advance of the maize undergoes the same cycle of drying, sweating—discharge onto the plate of the lower stage—sweating in block B2, then, after passing through plate 338, through the same channel system as before, the advance is repeated in a similar fashion in block B3 until the grains are discharged.

In this particular case, the treatment fluid used for creating the fluidized beds is atmospheric air. This air is fed at ambient temperature to the bottom of the apparatus where it is used for cooling the grains in the two stages of block B3. During this cooling period, the tangible heat of the maize is used for achieving the drying operation and raising the temperature of the air. The circulation of air inside the apparatus is provided by one (or more) fan(s) depending on the constructions. By way of example, the pressure loss of a bed of grains of a height of 50 cm is about 408 mm water column (4001.11 Pa).

This air is then directed towards the heat exchanger 310 associated with region A3, where its temperature is increased before feeding it to the stages of block B2. The desired value of the temperature at the output of exchanger 310 depends on the maximum admissible temperature in the layer of grains at the output of the last stage of block B2. This latter, set at about 90° C. in the case of maize, itself depends on the dry material flow rate.

At the output of block B2, the air which is still hot is fed to the heat source 310 and its temperature is again increased before being fed into block B1. For the same reasons as before and, so as to reach a maximum admissible temperature of the layer of grains at the output of block B1 (about 120° C.), the desired value of the temperature at the output of the heat source 310 varies as a function of the layer heights. The two above mentioned temperatures are temperatures particularly adapted for drying maize. They allow the drying of the grains to be carried out with a low rate of degradation of the proteins. The improvement of the qualities of the dried product is very important; it conditions the quality of the products issuing from the transformation industries (animal foods, semolina, rice, distilleries, starch factories etc).

On leaving block B1, the air which is still hot and humid is fed to the dust removal system 330, (cyclone) for recovering the dust and follicles which are used in different industries, such as the animal food industries and chemical industries.

The first plate at the top of stage 1 may be advantageously equipped with a device for removing the cobs floating at the surface of the fluidized maize bed.

The presence of a dust removal system is therefore advantageous for recovering the waste carried by the gaseous flow. This waste is detached from the treated product very often at the beginning of the operation and removal thereof is facilitated by the use of the method of putting the particles in suspension. This possibility of removing a large part of the waste at the beginning of the treatment reduces the risk of fires due to clogging up of the whole of the apparatus.

Insofar as the residence time of the maize in the device which has just been described is concerned, it depends on the initial humidity of the grains and on the chosen treatment temperature. In the case of maize, it is in the range of about 66 to about 96 minutes for an initial variation of humidity of 30% to 40% and an average treatment temperature of about 100° C. The residence time in each stage may vary from 11 to 16 minutes. For drying maize, the rotation speed of the central shaft 317 may vary preferably from 0.09 to 0.0625 rpm.

It will also be noted that the device of FIG. 7 may be completed for example by a system for the continuous determination of the humidity of the grains, using for example the infrared measurement principle. Furthermore, complete automation of the drier is facilitated by the adjustment of the rotational speed of the blades.

The design of an apparatus of this type may also be adapted without difficulty to the drying of cereals other than maize.

Figure 8:
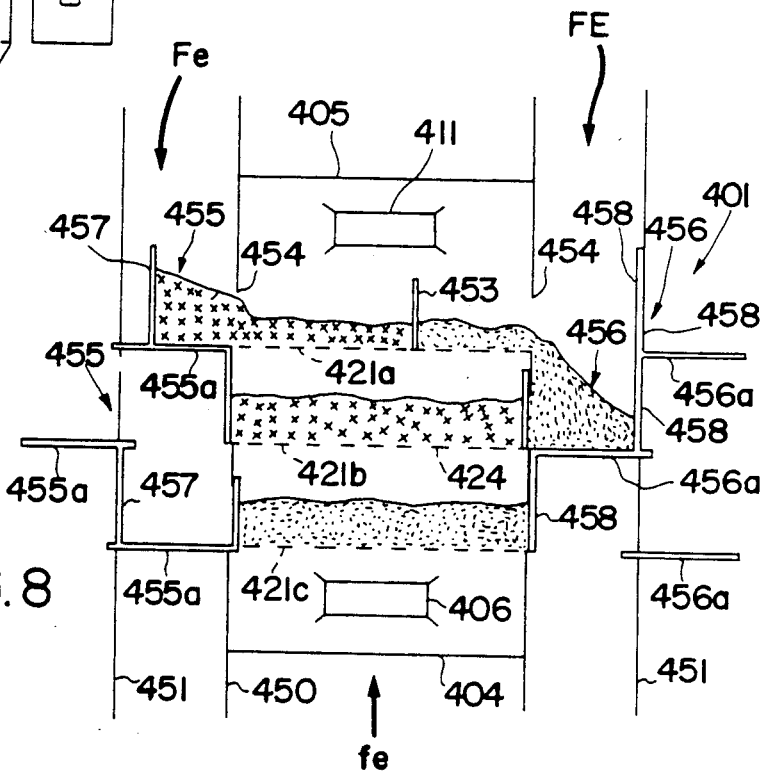
FIG. 8 is a schematical axial sectional view of a drying device according to a second embodiment of the invention.

Referring now to FIG. 8, at 401 can be seen, as a whole, a second device for drying maize, which has three treatment stages like device 101, the structure of these stages differing from that described above with reference to devices 101 and 301 by the fact that it leads to a rectilinear and not a circular displacement of the grains in each stage.

Device 401 has a rectangular section. It includes a central part 450 of rectangular section and two side parts 451 secured to the central part, along its walls of smallest width. The central part 450 forms the drying part and the side parts 451 those for sweating and transferring the product from one stage to the lower stage.

Thus, the central part 450 has internally three stationary perforated plates 421*a* to 421*c* which may be disposed at equal distance from each other, perpendicularly to the axis of device 401. It is closed by a bottom plate 404 and by a cover plate 405, both perpendicular to the axis of said device 401.

As in the preceding embodiment, the dimension of the perforations 424 of plates 421*a* to 421*c* is chosen as a function of the size of the particles to be dried.

On each plate 421*a* to 421*c* a blade 453 is movable perpendicularly thereto. Furthermore, above each plate 421*a* to 421*c* and on each side thereof, a rectangular opening 454 is provided over the whole width of the corresponding side wall defining part 450. Blade 453 has the height such that it may, when it is applied against one or other of these side walls, close off the whole of each of these openings 454. Blade 453 is adapted for scraping the whole of the grain present on the plate for transporting it from one end to another between the two openings 454.

The side parts 451 serve for supporting hoppers, at the rate of two per stage, those located at the left in FIG. 8 bearing the reference 455 and those located at the right the reference 456. Each end has a bottom 455*a* or 456*a* occupying all the space of the corresponding part 451, in the plane of the associated plate 421 and being movably mounted so as to be able to undergo a translational movement outwardly opposite plate 421.

In each hopper 455 or 456 there is further provided, for movement perpendicularly to the bottom 455*a* or 456*a*, a blade, 457 or 458 depending on whether it equips hopper 455 or hopper 456, extending over the whole width of the corresponding part 451. Blades 457 and 458 have a greater height than blades 453.

In one of the side walls of greatest width of part 450 are formed openings 406 and 407 which are the equivalents of openings 6 and 11 of device 1 of FIG. 1 for the inlet and outlet of air creating the fluidized beds, the intake and discharge ducts (not shown in FIG. 8) possibly including means similar to means 10 of apparatus 1.

The operation of apparatus 401 which has just been described is the following (FIGS. 9A to 9D).

Figure 9A:
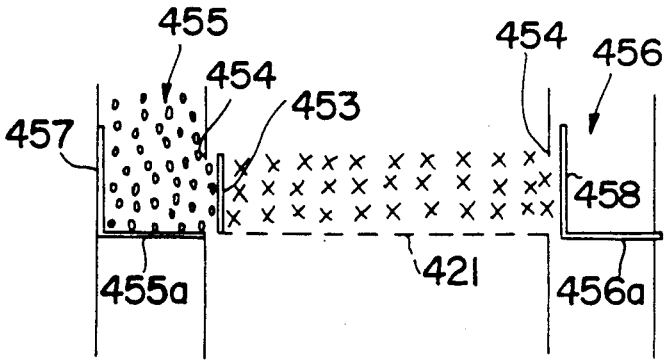
FIGS. 9*a* to 9*d* are schematical axial sectional views of a treatment stage of the apparatus of FIG. 8, for explaining the phases of displacement of the grain.

If the study of the operation of the apparatus begins by filling the left hand hopper 455, the operating sequence of a treatment stage is the following:

Initial situation of the blades:

blade 457 of the left hand hopper 455 is against the outer wall of the corresponding part 451;

the central blade 453 closes the opening 454 of said hopper 455; and blade 458 of the right hand hopper 456 closes the opening 454 of this hopper 456 (FIG. 9A).

Operation 1—the left hand hopper 455 is filled with a first batch of maize.

Figure 9B:
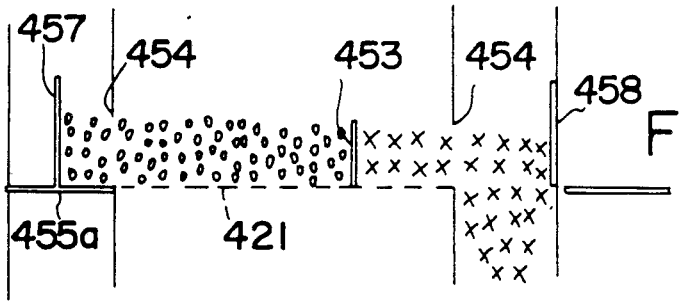

Operation 2—the central blade 453 moves along plate 421 in the direction of the opposite opening 454, whereas blade 458 of the right hand hopper 456 moves towards the outer wall of part 451 and blade 457 of the left hand hopper 455 closes the access opening 454 to plate 421 (FIG. 9B).

Figure 9C:
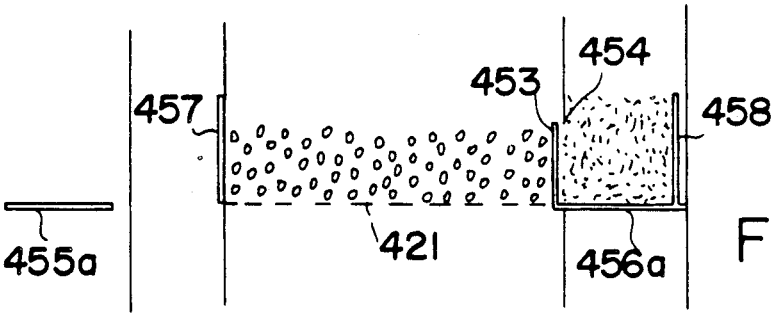

Operation 3—during the period of drying the batch of maize in the left hand hopper 455, the bottom 455*a* of this same hopper 455 opens. At the same time, the right hand hopper 456 is filled (FIG. 9C).

Figure 9D:
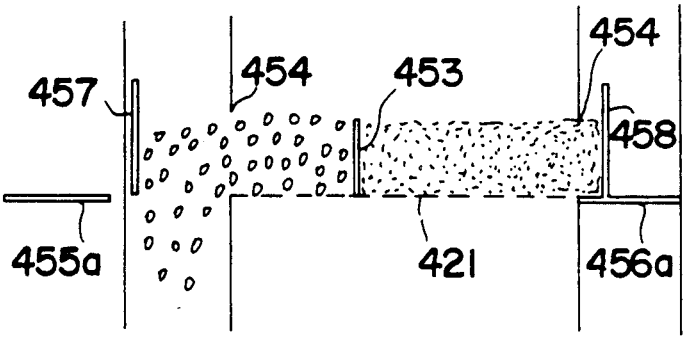

Operation 4—at the end of the drying period, the same process takes place in the reverse direction and during the return of the central blade 453 towards the left hand opening 454, the layer of grains located on the left hand side of the central blade 453 falls by gravity into the lower left hand hopper, whereas the grain contained in the right hand hopper 456 settles on plate 421 (FIG. 9D).

Operation 5—the blade 458 of the right hand hopper 456 closes opening 454 for the duration of the drying period; The bottom of the left hand hopper closes again and a new filling is possible.

Since filling and emptying of the two lateral hoppers take place alternately, the total residence time per stage (drying time on plate 421) plus rest time (that is to say sweating) must be identical for all stages. However, it is possible to divide the residence time per stage into different rest and fluidization times for each stage to the extent that the sum thereof may remain constant for the whole duration of these permanent working conditions.

Figure 10:
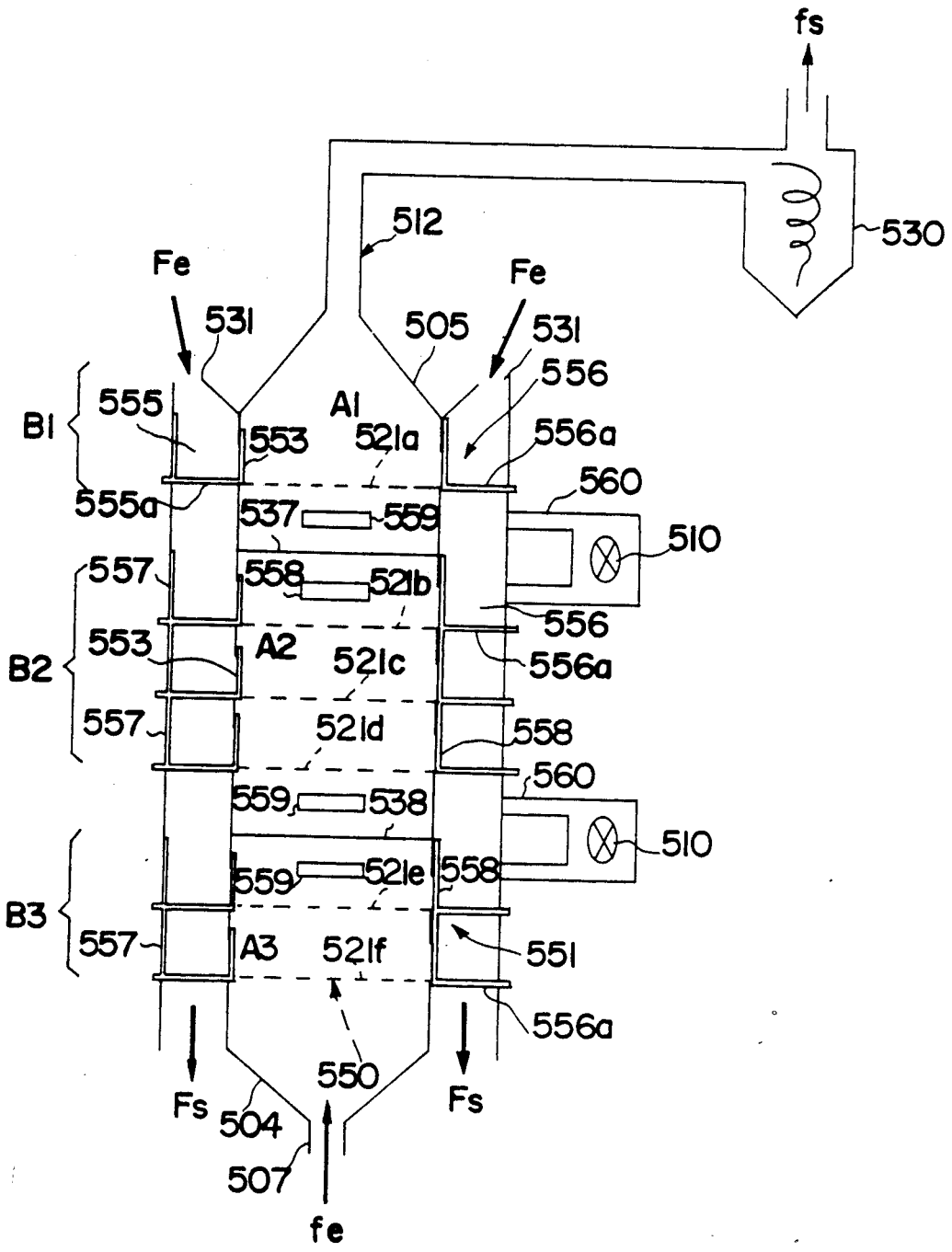
FIG. 10 is a view similar to FIG. 7 of a complete apparatus for drying maize in the structure of which the device shown in FIG. 8 is integrated.

In FIG. 10, a maize drying apparatus 501 has been shown which has the same overall structure as apparatus 301, the treatment stages been constructed like those of apparatus 401. The description of apparatus 501 will not be made in detail because of the common points to both the previously described apparatuses. In FIG. 10, the reference figures used are greater by 200 or 100 than those used for designating the similar elements of apparatus respectively 301 and 401.

Two external ducts 560 opening at 559 into the central part 550 connect together two adjacent zones A1–A2 and A2–A3. In these ducts are disposed the members 510 similar to members 10 and 410 of the previously described apparatuses 1 and 401.

The parameters which govern the operation of the driers of the invention are given below, the values being given by way of example.

the diameter of the column conditions the air flow which, for maize, must correspond to a speed through an empty duct of 1.9 m/s. Thus, for a diameter of 1 m, the required air flow is about 4800 kg/hour.

the flow of material dried according to the standards (15% humidity) at the output of the drier depends on the diameter of the column, on the initial humidity of the product, on the height of the layers of grains and on the drying kinetics which determine the residence time. For a column diameter of 1 m and drying kinetics such as mentioned above, the variations of the material flow rates are the following:

| height of layers in cm | initial humidity in % | flow rate of material dried to 15% in kg/h |
|---|---|---|
| 30 | 40 | 390 |
| 20 | 30 | 760 |
| 50 | 40 | 980 |
| 50 | 30 | 1900 |

the temperatures for treating the product which determine the drying kinetics are chosen so as to obtain a dried product whose food qualities are preserved. To this end, the air temperatures at the outputs of heat sources 310 or 510 are adjusted as a function of the dry material flow rate. Thus, the first part of drying (from 30 to 20% for example) is carried out from the input temperature of the maize (namely 20° C.) until the temperature of the layer reaches 120° C. From 20 to 15% humidity, the temperature of the layer is kept between 80° and 90° C., the temperature at which the rate of degradation of the proteins remains low.

Examples of temperatures at the output of heat sources 310 or 410

| Examples of temperatures at the output of heat sources 310 or 410 | | |
|---|---|---|
| Flow of material dried to 15% in kg/h | Temperature of lower heat source | Temperature of upper heat source |
| 760 | 105° C. | 160° C. |
| 1900 | 120° C. | 250° C. |

The temperatures of the heat sources vary as a function of the air flow/grain flow ratio.

What is claimed is:

1. A process for drying material in divided form capable of being dried in depth comprising contacting said material in a fluidized bed with a hot upward flowing drying fluid with alternating steps of drying and sweating the material being treated, the sweating being effected in the absence of drying fluid circulation about the divided material, the heat required for the drying being supplied only by the drying fluid, the transport of the divided material being effected by a mechanical device dividing the material into partitioned sectors to avoid axial mixing of the divided material between the sectors.

2. The process of claim 1 wherein said drying fluid and said divided material flow countercurrently.

3. The process of claim 2 wherein said divided material flows downwardly.

4. The process of claim 1 further comprising adjusting times of said drying and said sweating based on the moisture content of said divided material.

5. The process of claim 1 wherein each of said sectors containing one of said increments.

6. The process of claim 1 wherein said drying, said sweating, and said alternating comprise a treatment stage, there being at least two said treatment stages.

7. The process of claim 6 wherein said treatment stages are superposed.

8. The process of claim 1 wherein said drying, said sweating, and said alternating comprise a treatment stage having a drying area and a sweating area, the ratio of said drying area to said sweating area being based on the ratio of drying time to sweating time.

9. The process of claim 1 wherein said divided material is transported from one stage to another outside said drying zone.

10. The process of claim 1 wherein said drying, said sweating, and said alternating comprise a treatment stage, a plurality of treatment blocks each comprising at least one treatment stage, said drying fluid being at a different temperature upon entry into each of at least two of said treatment blocks.

11. The process of claim 10 wherein said plurality of treatment blocks comprises a first block comprising a predrying stage, a second block comprising a plurality of drying stages, and a third block comprising at least one cooling stage.

12. The process of claim 11 wherein said third block comprises two cooling stages.

13. The process of claim 11 wherein said first block is above said second block and said second block is above said third block.

14. The process of claim 11 wherein light waste is driven to a free surface of said first block, said waste being removed prior to optionally recycling said divided material.

15. The process of claim 1 wherein said divided material is transported at a speed which is adjusted based on said moisture content.

16. The process of claim 1 wherein said drying fluid has heating characteristics which are adjusted based on said moisture content.

17. The process of claim 1 wherein said moisture content is determined at different points in said process and conditions of drying and/or sweating are modified by adjustment of said drying temperature and/or said speed.

18. The process of claim 1 wherein said divided material has drying kinetics limited by internal diffusion of water.

* * * * *

UNITED STATES PATENT AND TRADEMARK OFFICE

CERTIFICATE OF CORRECTION

PATENT NO. : 5,002,787

DATED : Mar. 26, 1991

INVENTOR(S) : Patricia Fraile and Henri Renon

It is certified that error appears in the above-identified patent and that said Letters Patent is hereby corrected as shown below:

On the title page, item [73], the assignee, "Association pour la Recherche et le Des Methodes et Processus Industrieles (A.R.M.I.N.E.S.), Paris, France"

should be

--Association Pour La Recherche et le Developpement Des Methodes et Processus Industriels (A.R.M.I.N.E.S.)--.

Signed and Sealed this

Tenth Day of December, 1991

*Attest:*

HARRY F. MANBECK, JR.

*Attesting Officer*

*Commissioner of Patents and Trademarks*